US012150550B2

(12) United States Patent
Nachbaur

(10) Patent No.: US 12,150,550 B2
(45) Date of Patent: Nov. 26, 2024

(54) DEVICE FOR GUIDING A MOVABLE FURNITURE PART

(71) Applicant: Grass GmbH, Hoechst (AT)

(72) Inventor: Juergen Nachbaur, Hohenems (AT)

(73) Assignee: Grass GmbH, Hoechst (AT)

( * ) Notice: Subject to any disclaimer, the term of this patent is extended or adjusted under 35 U.S.C. 154(b) by 118 days.

(21) Appl. No.: 18/045,851

(22) Filed: Oct. 12, 2022

(65) Prior Publication Data

US 2023/0117910 A1 Apr. 20, 2023

(30) Foreign Application Priority Data

Oct. 14, 2021 (DE) ..... 10 2021 126 657.2

(51) Int. Cl.
*A47B 88/493* (2017.01)
*A47B 88/487* (2017.01)

(52) U.S. Cl.
CPC ..... *A47B 88/493* (2017.01); *A47B 88/487* (2017.01)

(58) Field of Classification Search
CPC ... A47B 88/493; A47B 88/487; A47B 88/437; A47B 2210/0059; A47B 2210/0035; A47B 2210/0056; A47B 2210/0032; A47B 2210/0037
See application file for complete search history.

(56) References Cited

U.S. PATENT DOCUMENTS

| | | | |
|---|---|---|---|
| 3,243,247 | A | 3/1966 | Knape |
| 2005/0012440 | A1 | 1/2005 | Hoshide et al. |
| 2012/0248956 | A1 | 10/2012 | Netzer |
| 2021/0037971 | A1 | 2/2021 | Andersson |

FOREIGN PATENT DOCUMENTS

| | | | |
|---|---|---|---|
| CN | 111655077 | A | 9/2020 |
| DE | 20 2010 014 328 | U1 | 1/2011 |
| WO | 2011/066592 | A1 | 6/2011 |

OTHER PUBLICATIONS

German Search Report (Application No. 10 2021 126 657.2) dated Aug. 3, 2022.
European Search Report (Application No. 22200622.3) dated Feb. 27, 2023.

*Primary Examiner* — Kimberley S Wright
(74) *Attorney, Agent, or Firm* — BURR PATENT LAW, PLLC

(57) ABSTRACT

A device for guiding a movable furniture part received movably on a furniture carcass, including a carcass rail and a drawer rail, wherein the movably mounted drawer rail is moved in an opening and closing direction relative to the carcass rail. The carcass and drawer rails each have at least one flat running surface, wherein the running surface of the drawer rail is continuously uniformly flat. During relative movement between the drawer and carcass rails, load-transmitting rolling elements move along the running surface of the carcass and drawer rails. The running surface extends in a longitudinal extent and a transverse extent, wherein the longitudinal extent is perpendicular to the transverse extent, and the longitudinal extent of the running surface is oriented in the opening and closing direction of the drawer rail.

9 Claims, 5 Drawing Sheets

DEVICE FOR GUIDING A MOVABLE FURNITURE PART

This application claims the benefit under 35 USC § 119(a)-(d) of German Application No. 10 2021 126 657.2 filed Oct. 14, 2021, the entirety of which is incorporated herein by reference.

FIELD OF THE INVENTION

The present invention relates to a device for guiding a movable furniture part.

BACKGROUND OF THE INVENTION

There are already known devices with rails for guiding a movable furniture part, wherein a lowering of the movable furniture part in the open state of the movable furniture part relative to the furniture carcass is counteracted.

In known devices, the diameter or the material of rolling elements in a carriage, which are moved along the running surfaces of the rails of the device, are changed.

SUMMARY OF THE INVENTION

It is the object of the present invention to provide an improved device for guiding a movable furniture part relative to a furniture carcass, in particular, with regard to a compact and simple construction.

The present invention starts from a device for guiding a movable furniture part, in particular, a drawer, which can be received movably on a furniture carcass by means of the device, wherein the device comprises a carcass rail and a drawer rail, wherein the carcass rail can be arranged on the furniture carcass, wherein the movably mounted drawer rail can be moved in an opening and closing direction relative to the carcass rail, wherein the carcass rail and the drawer rail each have at least one flat running surface, wherein the running surface of the drawer rail is continuously uniformly flat, wherein, during the relative movement between the drawer rail and the carcass rail, load-transmitting rolling elements can be moved along the running surface of the carcass rail and the drawer rail, wherein the running surface extends in a longitudinal extent and a transverse extent, wherein the longitudinal extent is designed to be perpendicular to the transverse extent, wherein the longitudinal extent of the running surface is oriented in the opening and closing direction of the drawer rail.

The device is preferably a drawer pull-out guide, in particular, a partial-extension runner. The furniture preferably has two identical devices, wherein in each case one device is arranged between a side wall of the furniture carcass and a side wall of the movable furniture part. In the mounted state, the carcass rail is preferably secured on the furniture carcass and the drawer rail is preferably secured on the movable furniture part. Advantageously, the drawer rail with the movable furniture part arranged thereon can be moved linearly relative to the carcass rail arranged, for example, in a fixed position on a side wall of the furniture carcass, wherein the drawer rail can be moved in the opening and closing direction relative to the carcass rail.

The movable furniture part preferably rests on a running web of the drawer rail, in particular, on a surface of the running web of the drawer rail which is oriented horizontally or at least virtually horizontally in the mounted state of the device. The movable furniture part preferably rests on an upper surface of the running web of the drawer rail, wherein rolling elements can preferably be moved along a lower surface of the running web of the drawer rail. The upper and lower surfaces are preferably arranged opposite one another on the running web and are separated from one another by the material thickness of the running web of the drawer rail. The lower surface of the running web of the drawer rail preferably forms a running surface. Advantageously, rolling elements, such as, for example, balls or rollers, are arranged between the lower surface or running surface of the drawer rail and a running surface of the carcass rail.

The carcass rail advantageously has a running web with two running surfaces, wherein the running surfaces are preferably oriented horizontally in the mounted state of the device. Advantageously, one running surface of the carcass rail is located on a lower surface and one running surface on an upper surface of the running web, wherein the running surfaces are spaced apart from one another by the thickness of the running web. The drawer rail preferably has two running webs. In this case, preferably in the mounted state of the device, the horizontally oriented running web of the carcass rail is arranged between the running webs, in particular, horizontally oriented running webs, of the drawer rail. Respective rolling elements are preferably arranged between the running web of the carcass rail and the running webs of the drawer rail, thus enabling rolling elements to be moved along both running surfaces of the running web of the carcass rail.

In the case of the drawer rail, preferably on the upper running web situated above the running web of the carcass rail, it is only possible for rolling elements to be moved along the lower surface or running surface, which is oriented toward the running web of the carcass rail, and, on the lower running web situated below the running web of the carcass rail, it is only possible for rolling elements to be moved along the upper surface or running surface, which is oriented toward the running web of the carcass rail. The rolling elements which are arranged between the running web of the carcass rail and the running webs of the drawer rail are preferably arranged on a carriage, thus enabling all the rolling elements to be moved simultaneously in the opening or closing direction along the running surfaces of the running webs of the drawer rail and the carcass rail. Furthermore, it is conceivable that the rolling elements are arranged on a plurality of carriages, wherein, for example, the movement of two or more carriages can be synchronized.

The running webs or the running surfaces of the carcass rail and drawer rail are advantageously designed to be uninterrupted. This means, for example, that there is no space or gaps in the running web or running surface. This has the advantage that the rolling elements can be moved along the entire running surfaces of the carcass rail and drawer rail and that smooth running of the drawer rail in the opening and closing direction is ensured.

The two running webs or running surfaces of the drawer rail are preferably designed to be flat. The running surface or running surfaces of the drawer rail are advantageously oriented horizontally in the mounted state of the device on the furniture. It is preferable if a longitudinal extent of the running surface runs along the opening and closing direction, and a transverse extent is oriented perpendicularly to the longitudinal extent, wherein the longitudinal extent and transverse extent of the running surface preferably lie in one plane.

The crux of the present invention is that the longitudinal extent of the running surface of the carcass rail is divided into two running sections, wherein the running sections of the running surface merge into one another without an offset, wherein, relative to a plane of a second running section, a plane of a first running section is aligned obliquely as regards the longitudinal extent and is not tilted as regards the transverse extent.

The running surfaces of the rails lie in one plane, wherein the running surfaces are bounded by four edges, wherein two edges run along a width and two edges run along a length. If the running surface has two running sections, the first and second running sections each lie in a plane which is also bounded by four edges, wherein a fourth edge runs within the running surface, preferably along a width.

The second running section of the running surface of the carcass rail preferably has a single plane, wherein the longitudinal extent of the plane of the carcass rail is advantageously oriented parallel to the longitudinal extent of the running surface or running surfaces of the drawer rail. It is advantageous if the longitudinal extents of a plane each have the same length and run parallel to one another, ensuring that the longitudinal extents of a plane are the same. In the mounted state of the device on the furniture, the longitudinal extents of the running surfaces of the drawer rail, as well as the longitudinal extent of the second running section of the running surface of the carcass rail, are preferably oriented horizontally.

It is advantageous if the first running section of the running surface of the carcass rail has a single plane. The plane of the second running section of the running surface of the carcass rail preferably merges without an offset into the plane of the first running section of the running surface of the carcass rail, or the planes adjoin one another. In this case, the plane of the first running section of the running surface of the carcass rail is preferably oriented obliquely or transversely relative to the plane of the second running section of the running surface of the carcass rail, as regards the longitudinal extent. The longitudinal extent of the plane of the first running section of the running surface of the carcass rail is preferably oriented transversely with respect to a horizontal and a vertical in the mounted state of the device on the furniture. The longitudinal extent of the plane of the first running section of the running surface of the carcass rail preferably runs obliquely upward, starting from the plane of the second running section of the running surface of the carcass rail, in the direction of the drawer rail running surface situated above the carcass rail. In this case, the enclosed angle between a longitudinal extent of the first running section of the running surface of the carcass rail and a longitudinal extent of the second running section of the running surface of the carcass rail is preferably greater than 170° and less than 180°.

Furthermore, the transverse extent of the plane of the first running section of the running surface of the carcass rail and the transverse extent of the plane of the second running section of the running surface of the carcass rail run in the same direction or parallel to one another. The carriage or the rolling elements in the carriage is or are thus advantageously not tilted in the transverse extent when moving along the running surface of the carcass rail or along the running sections of the running surface of the carcass rail.

Furthermore, the first running section of the running surface of the carcass rail can also have a plurality of planes, wherein at least one plane of the first running section of the running surface of the carcass rail is oriented obliquely relative to the planes of the second running section of the running surface of the carcass rail, as regards the longitudinal extent. The planes of the first running section of the running surface of the carcass rail preferably merge into one another without an offset. It is conceivable that the first running section of the running surface of the carcass rail has a curved shape. The first running section is preferably configured in such a way that a cross section along the longitudinal extent of the first running section is configured in a curved shape. In this case, it is possible, directly after the second running section, for the first running section to have a slope in the direction of the upper running web of the drawer rail or along the course of the first running section. With both possibilities, in the mounted state of the device the first running section advantageously ends at a vertical distance from the second running section in the direction of the upper running web of the drawer rail.

In this case, the transverse extents of the different planes of the first running section of the running surface of the carcass rail are preferably oriented parallel to one another or not tilted relative to one another. The longitudinal extents of the different planes of the first running section of the running surface of the carcass rail are, for example, oriented obliquely with respect to one another.

As the drawer rail moves in the opening direction, the rolling elements are preferably moved along the running surface of the carcass rail, and the rolling elements pass from the second running section to the first running section. When the rolling elements are on the second running section of the running surface of the carcass rail, the running surface of the carcass rail is advantageously oriented parallel to the running surface of the drawer rail. When the rolling elements are on the second running section of the running surface of the carcass rail, the running surfaces of the drawer rail are preferably oriented horizontally in the mounted state of the device on the furniture. When the rolling elements reach the first running section of the running surface of the carcass rail, the running surfaces or the running webs of the drawer rail are oriented obliquely upward relative to the longitudinal extent of the plane of the second running section of the carcass rail. The running webs of the drawer rail are thus oriented obliquely or transversely with respect to the horizontal and the vertical. Owing to the oblique position of the running webs of the drawer rail in the open state or extended state of the drawer rail or of the movable furniture part, it is advantageously possible to compensate for lowering of the movable furniture part, in particular, of a fully loaded movable furniture part. This is because, in standard devices for guiding a movable furniture part, the movable furniture part or the drawer rail in the open state is deflected downward in the direction of the carcass rail or obliquely with respect to a horizontal by the weight of the movable furniture part or the content of the movable furniture part. Owing to the oblique orientation of the running webs of the drawer rail, the running webs or running surfaces of the drawer rail are pushed or deflected into an approximately horizontal position by the weight of the movable furniture part. As a result, in contrast to the standard devices, the movable furniture part, in particular, a heavy movable furniture part, can advantageously be closed without great expenditure of force.

Another advantageous variant starts from a device for guiding a movable furniture part, in particular, a drawer, which can be received movably on a furniture carcass by means of the device, wherein the device comprises a carcass rail, a drawer rail and a central rail, wherein the central rail is arranged between the carcass rail and the drawer rail, wherein the carcass rail can be arranged on the furniture carcass, wherein the movably mounted drawer rail and the central rail can be moved in the opening and closing direction relative to the carcass rail, wherein the carcass rail, the central rail and the drawer rail each have at least one flat running surface, wherein the running surface of the drawer rail is continuously uniformly flat, wherein, during the movement of the drawer rail and/or central rail relative to the carcass rail, load-transmitting rolling elements can be moved along the running surfaces of the rails, wherein the running surface extends in a longitudinal extent and a transverse extent, wherein the longitudinal extent is designed to be perpendicular to the transverse extent, wherein the longitudinal extent of the running surface of the rails is oriented in the opening and closing direction of the drawer rail, wherein the longitudinal extent of the running surface of the carcass rail and/or central rail is divided into two running sections, wherein the running sections of the running surface merge into one another without an offset, wherein, relative to a plane of a second running section, a plane of a first running section is oriented obliquely as regards the longitudinal extent and is not tilted as regards the transverse extent.

This variant of the device is preferably a full-extension runner for the movement of the movable furniture part relative to the furniture carcass. Here, the device has a carcass rail, a central rail and a drawer rail, wherein when the movable furniture part is moved in the opening and closing direction, both the central rail and the drawer rail are moved relative to the carcass rail. Furthermore, during the opening and closing movement of the movable furniture part, the drawer rail can preferably also be moved relative to the central rail. The carcass rail is preferably mounted on the furniture carcass of the furniture, and the movable furniture part is preferably connected to the drawer rail. The central rail is preferably arranged between the drawer rail and the carcass rail.

The carcass rail advantageously has a running web with two running surfaces, wherein the running surfaces are preferably oriented horizontally in the mounted state of the device. Advantageously, one running surface of the carcass rail is located on a lower surface and one running surface on an upper surface of the running web, wherein the running surfaces are spaced apart from one another by the thickness of the running web. The central rail preferably has two running webs. In this case, preferably in the mounted state of the device, the horizontally oriented running web of the carcass rail is arranged between the running webs, in particular, horizontally oriented running webs, of the central rail.

Respective rolling elements are preferably arranged between the running web of the carcass rail and the running webs of the central rail, thus enabling rolling elements to be moved along both running surfaces of the running web of the carcass rail. In the case of the central rail, preferably on the upper running web situated above the running web of the carcass rail, it is possible for rolling elements to be moved along the lower surface or running surface, which is oriented toward the running web of the carcass rail, and, on the lower running web situated below the running web of the carcass rail, it is possible for rolling elements to be moved along the upper surface or running surface, which is oriented toward the running web of the carcass rail. In this case, the running surfaces of the carcass rail and the central rail are preferably spaced apart vertically in the mounted state of the device, the vertical spacing advantageously being predetermined by the diameter or thickness of the rolling elements. The rolling elements which are arranged between the running web of the carcass rail and the running webs of the central rail are preferably arranged on a carriage, thus enabling all the rolling elements to be moved simultaneously and jointly in the opening or closing direction along the running surfaces of the running webs.

The upper running web or the running web of the central rail which is arranged above the running web of the carcass rail preferably has two running surfaces, wherein the upper running surface is oriented in the direction of a running surface of the drawer rail. Further rolling elements are preferably arranged between the upper running surface of the central rail and the running surface of the drawer rail. As a preferred option, the rolling elements which are arranged between the running surface of the central rail and the carcass rail are arranged on a carriage, and the rolling elements between the running surface of the central rail and the running surface of the drawer rail are arranged on a further carriage.

As a preferred option, only the longitudinal extent of the running surface of the carcass rail, only the longitudinal extent of the running surface of the central rail, or the longitudinal extent of the running surface of the carcass rail and of the central rail may have two running sections. In this case, a plane of the first running section is preferably oriented obliquely relative to the plane of the second running section, as regards the longitudinal extent. Advantageously, at least the running surface of the upper running web of the central rail has two running sections, wherein a plane of the first running section is oriented obliquely relative to the plane of the second running section, as regards the longitudinal extent. It is also conceivable that the running surface of the upper running web and the running surface of the lower running web of the central rail have two running sections, wherein in each case one plane of the first running section is oriented obliquely relative to the plane of the second running section, as regards the longitudinal extent.

The second running section of the running surface of the carcass rail and/or of the central rail preferably has a single plane, wherein the longitudinal extent of the plane of the carcass rail and/or of the central rail is advantageously oriented parallel to the longitudinal extent of the plane of the running surface or running surfaces of the drawer rail. In the mounted state of the device on the furniture, the longitudinal extent of the running surfaces of the drawer rail, as well as the longitudinal extent of the plane of the second running section of the running surface of the carcass rail and/or of the central rail, are preferably oriented horizontally.

It is advantageous if the first running section of the running surface of the carcass rail and/or of the central rail has a single plane. The plane of the second running section of the running surface of the carcass rail preferably merges without an offset into the plane of the first running section of the running surface of the carcass rail. Furthermore, the plane of the second running section of the running surface of the central rail preferably merges without an offset into the plane of the first running section of the running surface of the central rail.

In this case, the plane of the first running section of the running surface of the carcass rail is preferably oriented obliquely or transversely relative to the plane of the second running section of the running surface of the carcass rail, as regards the longitudinal extent. The plane of the first running section of the running surface of the central rail is preferably oriented obliquely or transversely relative to the plane of the second running section of the running surface of the central rail, as regards the longitudinal extent. The longitudinal extent of the plane of the first running section of the running surface of the carcass rail and/or of the central rail is preferably oriented transversely with respect to a horizontal and a vertical in the mounted state of the device on the furniture. The longitudinal extent of the plane of the first running section of the running surface of the carcass rail preferably runs obliquely upward, starting from the plane of the second running section of the running surface of the carcass rail, in the direction of the central rail running surface situated above the carcass rail. Furthermore, the longitudinal extent of the plane of the first running section of the running surface of the central rail preferably runs obliquely upward, starting from the plane of the second running section of the running surface of the central rail, in the direction of the drawer rail running surface situated above the central rail. In this case, for example, the enclosed angle between a longitudinal extent of the first running section of the running surface of the central rail and a longitudinal extent of the second running section of the running surface of the central rail is greater than 170° and less than 180°.

Furthermore, the transverse extent of the plane of the first running section of the running surface of the central rail and the transverse extent of the plane of the second running section of the running surface of the central rail run in the same direction or parallel to one another. The carriage or the rolling elements in the carriage is or are thus advantageously not tilted in the transverse extent when moving along the running surface of the central rail or along the running sections of the running surface of the central rail.

Furthermore, the first running section of the running surface of the central rail can also have a plurality of planes, wherein at least one plane of the first running section of the running surface of the central rail is oriented obliquely relative to the planes of the second running section of the running surface of the central rail, as regards the longitudinal extent. The planes of the first running section of the running surface of the central rail preferably merge into one another without an offset.

It is conceivable that the first running section of the running surface of the central rail has a curved shape. The first running section is preferably configured in such a way that a cross section along the longitudinal extent of the first running section is configured in a curved shape. In this case, it is possible, directly after the second running section, for the first running section to have a slope in the direction of the upper running web of the drawer rail or along the course of the first running section. With both possibilities, in the mounted state of the device the first running section advantageously ends at a vertical distance from the second running section in the direction of the upper running web of the drawer rail. In this case, the transverse extents of the different planes of the first running section of the running surface of the central rail are preferably oriented parallel to one another. The longitudinal extents of the different planes of the first running section of the running surface of the central rail are, for example, oriented obliquely with respect to one another.

During the movement of the movable furniture part in the opening direction, the central rail is moved relative to the carcass rail, and the drawer rail is moved relative to the carcass rail and the central rail.

One variant of the present invention is that only the running surface of the carcass rail has two running sections, wherein the longitudinal extent of the plane of the first running section of the running surface of the carcass rail is oriented obliquely or transversely with respect to the longitudinal extent of the plane of the second running section of the running surface of the carcass rail. In this case, it is only in the case of the carcass rail that the rolling elements which are arranged between the running surfaces of the central rail and the running surface of the carcass rail pass from the second running section to the first running section of the carcass rail. The longitudinal extent of the running web or the running surfaces of the central rail are preferably not oriented obliquely upward relative to the longitudinal extent of the second running section of the carcass rail until the rolling elements reach the first running section of the running surface of the carcass rail. As a result of the oblique position of the running surface of the central rail, the running web or the running surface of the drawer rail is also preferably oriented obliquely. This advantageously takes place only shortly before the fully open position of the movable furniture part is reached since it is only then that the rolling elements which are arranged between the running surfaces of the central rail and the running surface of the carcass rail reach the first running section of the running surface of the carcass rail. Owing to the oblique position of the drawer rail, lowering of the movable furniture part or of the running web of the drawer rail, on which the movable furniture part rests, can advantageously be compensated.

In the case where only the running surface of the central rail has two running sections, wherein the longitudinal extent of the plane of the first running section of the running surface of the central rail is oriented obliquely or transversely with respect to the longitudinal extent of the plane of the second running section of the running surface of the central rail. During the opening movement of the movable furniture part, the longitudinal extent of the second running section of the central rail remains parallel to the longitudinal extent of the running surface of the carcass rail. When the rolling elements which are arranged between the running surface of the drawer rail and the upper running surface of the central rail pass from the second running section to the first running section of the central rail, the longitudinal extent of the running surface of the drawer rail is oriented obliquely upward relative to the longitudinal extent of the second running section of the central rail. This preferably takes place only shortly before the fully open position of the movable furniture part is reached.

Another possibility is for both the running surface of the carcass rail and the running surface of the central rail to have two running sections. During the movement of the movable furniture part in the opening direction, on the one hand the rolling elements which are arranged between the running surfaces of the central rail and the running surface of the carcass rail pass onto the first running section of the running surface of the carcass rail, and on the other hand the rolling elements which are arranged between the upper running surface of the central rail and the running surface of the drawer rail pass onto the first running section of the upper running surface of the central rail. In this case, the longitudinal extent of the second running section of the running surfaces of the central rail is advantageously oriented obliquely relative to the second running section of the carcass rail, wherein the longitudinal extent of the first running section of the central rail is oriented obliquely relative to the longitudinal extent of the second running section of the central rail. Furthermore, the running web or the running surface of the drawer rail is preferably oriented obliquely relative to the longitudinal extent of the plane of the second running section of the central rail, wherein the longitudinal extent of the plane of the second running section of the central rail is already oriented obliquely relative to the longitudinal extent of the plane of the second running section of the carcass rail. As a result, the running surface of the drawer rail is oriented more obliquely than if only one rail had two running sections.

It is advantageous that the total longitudinal extent of the running surface has exactly two running sections.

The running surface of the carcass rail and/or central rail preferably comprises exactly two running sections, wherein the plane of the first and the plane of the second running section each preferably have a longitudinal extent. The longitudinal extent of the planes of the first running section and the longitudinal extent of the plane of the second running section together preferably form the total longitudinal extent of the running surface. Furthermore, the first running section can have a plurality of planes, which each have a longitudinal extent, and then the sum of the longitudinal extent of the planes of the first running section forms the longitudinal extent of the first running section.

It is likewise advantageous for a longitudinal extent of the first and second running sections in each case to have a starting point and an end point, wherein the starting point of the longitudinal extent of the second running section and the end point of the longitudinal extent of the first running section are in each case formed on an end-side edge of the running surface.

It is preferable if the total longitudinal extent of the running surface extends from the starting point of the longitudinal extent of the second running section to the end point of the longitudinal extent of the first running section. In the case of the carcass rail mounted on the furniture carcass in the mounted state, it is preferable if the starting point of the longitudinal extent of the second running section is situated in the direction of the rear wall of the furniture carcass, and the end point of the first longitudinal extent is situated at the opening of the furniture carcass or at a front-side region of the side wall of the furniture carcass. In the closed state of the movable furniture part, the end point of the longitudinal extent of the second running section in the case of the carcass rail is preferably arranged in the vicinity of a front of the movable furniture part. Since the central rail is movable relative to the carcass rail, the end points and starting points of the longitudinal extent of the central rail are displaced. In this case, the starting point of the longitudinal extent of the second running section of the central rail is arranged at an end-side end on the running surface in the closing direction, and the end point of the longitudinal extent of the first running section of the central rail is arranged at an end-side end on the running surface in the opening direction.

In the case of the device mounted on the furniture and in the closed state of the movable furniture part, the starting point of the longitudinal extent of the second running section of the central rail is also oriented in the direction of the rear wall of the furniture carcass.

It is advantageous if the end point of the longitudinal extent of the second running section corresponds to the starting point of the longitudinal extent of the first running section.

It is advantageous if the end point of the longitudinal extent of the second running section and the starting point of the longitudinal extent of the first running section are situated within the running surface. It is preferable if the end point of the longitudinal extent of the second running section or the starting point of the longitudinal extent of the first running section is more than 60%, preferably more than 70%, more than 80%, more than 90%, away from the starting point of the longitudinal extent of the second running section.

It is also advantageous that, in the mounted state of the device, the first running section is formed on a front end region of the rail in the opening direction of the drawer rail.

In the mounted state of the device on the furniture, the front end region of the carcass rail is preferably oriented in the direction of the opening of the furniture carcass. In the closed state of the movable furniture part, the front end region of the carcass rail is arranged close to the front of the movable furniture part.

Furthermore, in the closed state of the movable furniture part, the front end region of the central rail is preferably oriented in the direction of the opening of the furniture carcass. The front end region of the central rail is also oriented in the direction of the movable furniture part, wherein the front end region of the central rail is arranged in the vicinity of the front of the movable furniture part, in particular, of a drawer front of a drawer, in the closed state of the movable furniture part. During the opening movement of the movable furniture part in the opening direction, the relative movement between the drawer rail and the central rail causes the front end region of the central rail to move further and further away from the front of the movable furniture part.

It is advantageous that the longitudinal extent of the second running section of the rail extends over 60% to 90% of the total longitudinal extent of the running surface of the rail.

The longitudinal extent of the second running section advantageously extends over 60%, over 65%, over 70%, over 75%, over 80%, over 85%, of the total longitudinal extent of the running surface of the carcass rail and/or central rail.

It is preferable if the longitudinal extent of the second running section extends from the starting point of the second running section to the end point of the second running section, wherein the starting point of the second running section begins at a rear end-side edge of the running surface.

In the case of the carcass rail, the rear end-side edge of the running surface, at which the starting point of the second running section is arranged, is preferably arranged on a central to rear region of the side wall of the furniture carcass in the mounted state of the device on the furniture. The rear end-side edge of the carcass rail is preferably oriented in the direction of the rear wall of the furniture carcass and transversely to the direction of movement of the central rail and/or drawer rail.

In the case of the central rail, the rear end-side edge of the running surface, at which the starting point of the second running section is arranged, is arranged, in the closed state of the movable furniture part, on a rear region of the side wall of the furniture carcass, wherein the rear region of the side wall of the furniture carcass is connected to the rear wall of the furniture carcass. During the opening movement of the movable furniture part, the rear end-side edge of the running surface of the central rail is moved along the carcass rail, as a result of which the rear end-side edge of the running surface of the central rail is preferably positioned in the central region of the running surface of the carcass rail in the fully open state of the movable furniture part.

Another advantageous possibility is obtained if the longitudinal extent of the first running section of the rail extends over 10% to 40% of the total longitudinal extent of the running surface of the rail.

The longitudinal extent of the first running section advantageously extends over 10%, over 15%, over 20%, over 25%, over 30%, over 35%, of the total longitudinal extent of the running surface of the carcass rail and/or central rail.

It is preferable if the longitudinal extent of the first running section extends from the starting point of the first running section to the end point of the second running section, wherein the end point of the first running section is arranged at a front end-side edge of the running surface.

In the case of the carcass rail, the front end-side edge of the running surface, at which the end point of the first running section is arranged, is preferably arranged on a front region of the side wall of the furniture carcass in the mounted state of the device on the furniture, wherein the front region of the side wall of the furniture carcass is oriented toward the opening of the furniture carcass.

In the case of the central rail, the front end-side edge of the running surface, which has the end point of the first running section, is arranged above the front end-side edge of the running surface of the carcass rail in the closed state of the movable furniture part. During the opening movement of the movable furniture part, the front end-side edge of the running surface of the central rail is moved along the carcass rail, as a result of which the front end-side edge of the running surface of the central rail preferably comes to a halt in the central region of the running surface of the drawer rail and is at a distance from the running surface of the carcass rail in the fully open state of the movable furniture part.

It is likewise advantageous that, in the mounted state of the device, the longitudinal extent of the second running section is oriented horizontally.

In the mounted state, the carcass rail is connected to a side wall of the furniture carcass, wherein the running web or the longitudinal extents of the running surfaces of the rails are oriented horizontally. In the case of the rails on which the running surfaces have two running sections, it is advantageous if only the longitudinal extent of the second running section of the running surface is oriented horizontally. The longitudinal extent of the first running section of the rails with two running sections is preferably oriented obliquely with respect to the horizontal and the vertical in the mounted state.

In the mounted state of the device, the end point of the longitudinal extent of the first running section and the end point of the longitudinal extent of the second running section are advantageously spaced apart vertically from one another.

The vertical spacing or the height difference between the end point of the longitudinal extent of the second running section and the end point of the longitudinal extent of the first running section is preferably 0.2-2 mm. The end point of the longitudinal extent of the first running section is advantageously closer in the direction of the movable furniture part than the end point of the longitudinal extent of the second running section.

It is also preferable if the vertical spacing or the height difference between the starting point and the end point of the longitudinal extent of the first running section is 0.2 to 2 mm.

By means of the oblique position of the plane of the first running section relative to the plane of the second running section, the height difference is preferably achieved, whereby it is possible to counteract lowering of the movable furniture part in the open state of the movable furniture part.

An advantageous embodiment of the present invention is a piece of furniture having a movable furniture part which can be moved in the opening and closing direction relative to the furniture carcass by means of a device according to one of the preceding embodiments described.

BRIEF DESCRIPTION OF THE DRAWINGS

Further features and advantages of the present invention are explained in detail below by means of an exemplary embodiment illustrated schematically in the figures.

DETAILED DESCRIPTION OF THE INVENTION

Figure 1:
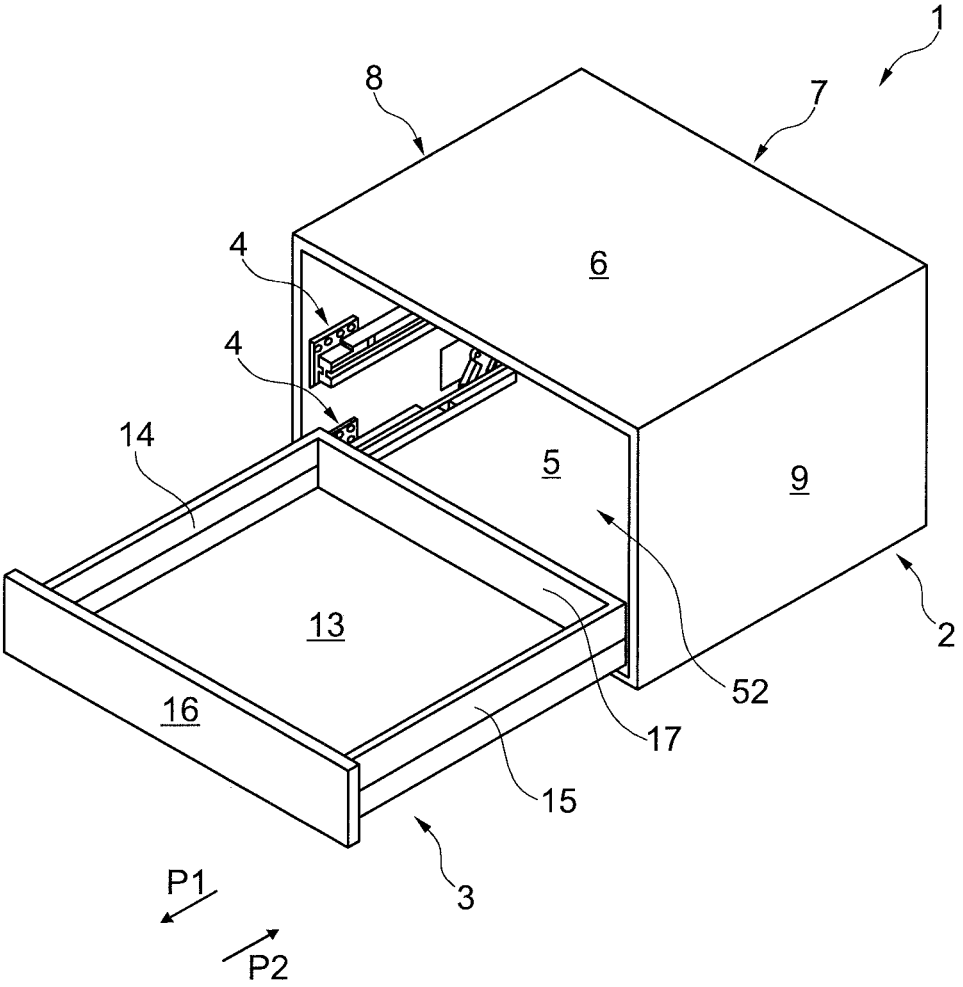
FIG. 1 shows a piece of furniture in perspective from obliquely above with a drawer in the fully opened state on a furniture carcass, wherein the drawer can be moved in the opening and closing direction by means of the device according to the present invention.

A piece of furniture 1 having a furniture carcass 2 and a drawer 3 which can be moved relative to the furniture carcass 2 is illustrated in FIG. 1. The drawer 3 can be moved relative to the furniture carcass 2 in the opening direction P1 and the closing direction P2 by means of the device 4 according to the present invention, such as, for example, a drawer pull-out guide. The furniture carcass 2 has a base 5, an upper panel 6, a rear wall 7 and two side walls 8, 9. The device 4 is preferably secured on the side walls 8, 9 of the furniture carcass 2. The device 4, which is designed as a full-extension runner, preferably has a carcass rail 10, a central rail 11 and a drawer rail 12 (see FIG. 2), wherein the carcass rail 10 is mounted on the side wall 8, 9 of the furniture carcass 2. Advantageously, a carcass rail 10 is attached to each side wall 8, 9 of the furniture carcass 2, wherein the carcass rails 10 are preferably attached to the side walls 8, 9 of the furniture carcass 2 in a mirror-symmetrical manner. Furthermore, the drawer 3 is preferably detachably connected to the drawer rail 12. The drawer 3 preferably has a drawer bottom 13, drawer side walls 14, 15, a drawer front 16 and a drawer rear wall 17, wherein the drawer bottom 13 preferably rests on the drawer rail 12.

Figure 3:
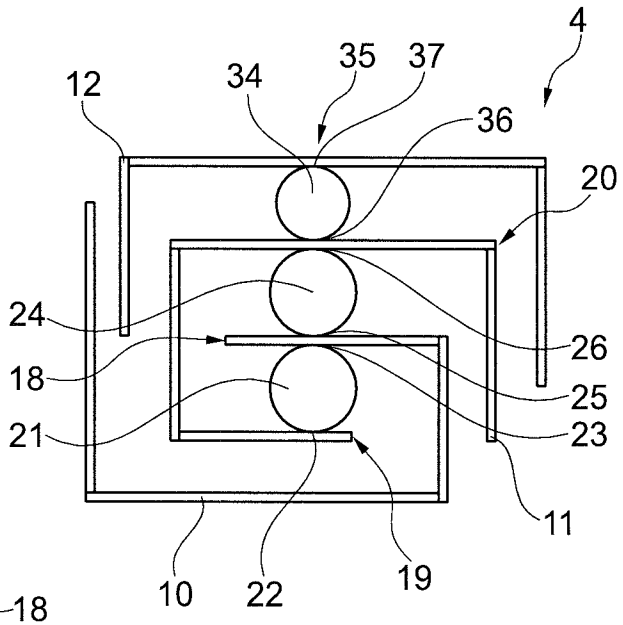
FIG. 3 shows a sectional view from the front of the device according to FIG. 2.
Figure 2:
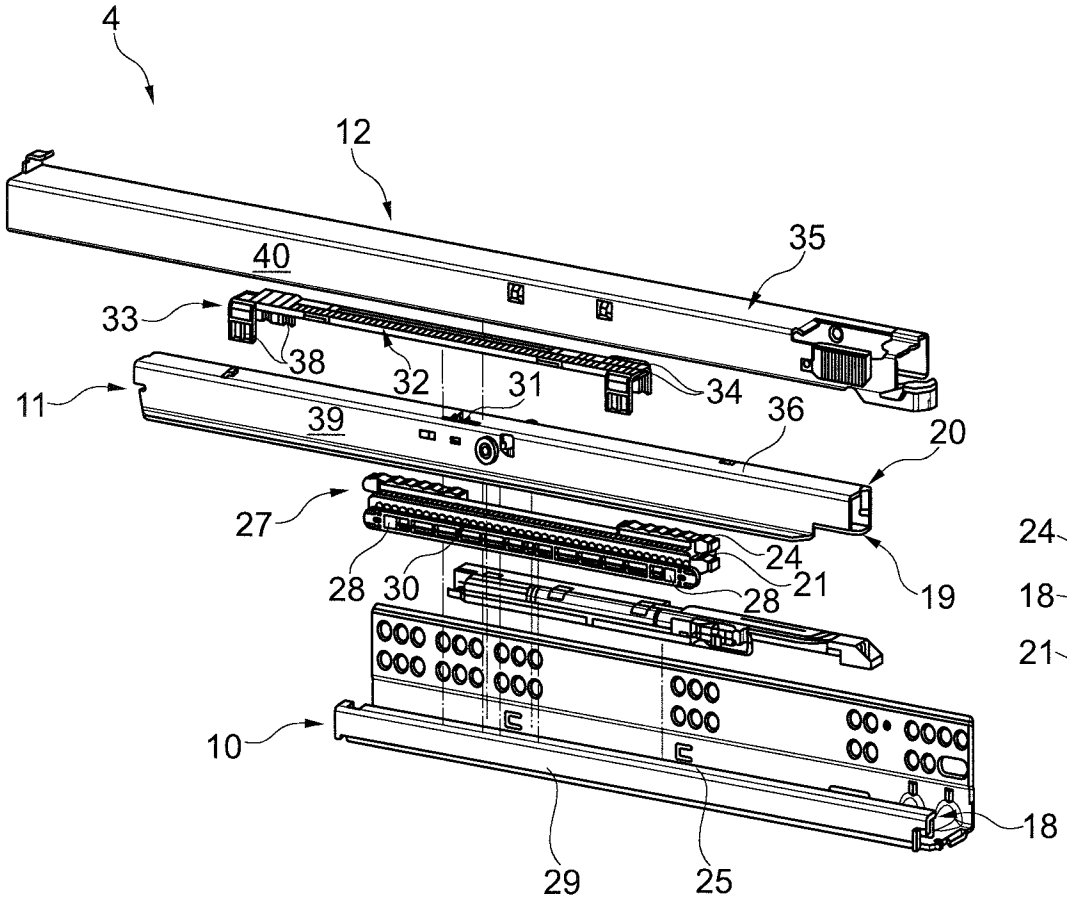
FIG. 2 shows an exploded illustration of a device according to the present invention.

The device according to the present invention is illustrated in FIG. 2, wherein the carcass rail 10 has a running web 18. Running webs 19, 20 of the central rail 11 are preferably arranged above and below the running web 18 of the carcass rail 10 (see FIG. 3). In this case, rolling elements 21 are arranged between the lower running web 19 of the central rail 11 and the running web 18 of the carcass rail 10. The rolling elements 21 can be moved along the running surface 22 of the lower running web 19 of the central rail 11 and the lower running surface 23 of the running web 18 of the carcass rail 10 during the movement of the central rail 11 relative to the carcass rail 10 or during the opening or closing movement of the drawer 3. Further rolling elements 24 are preferably arranged between the running web 18 of the carcass rail 10 and the upper running web 20 of the central rail 11, it being possible for the rolling elements 24 to be moved along the upper running web 25 of the running web 18 of the carcass rail 10 and the running web 26 of the upper running web 20 of the central rail 11.

The rolling elements 21, 24 are arranged, for example, in a carriage 27, wherein the carriage 27 preferably has an upper row with the rolling elements 24 and a lower row with the rolling elements 21. The running web 18 of the carcass rail 10 is preferably arranged between the two rows of rolling elements. Furthermore, the carriage 27 also has rolling elements 28 on the sides of the carriage 27, wherein the rolling elements 28 are moved along the lateral running webs 29 of the carcass rail 10 and/or the lateral running webs 39 of the central rail 11, thus enabling the carriage 27 to be moved along the running webs 18, 19, 20 and lateral running webs 29, 39 of the central rail 11 and carcass rail 10. An engagement element 30 is additionally formed on the carriage 27 and interacts with a synchronization wheel 31 on the central rail 11. The synchronization wheel 31 is rotatably arranged on the central rail 11, the synchronization wheel 31 also interacting with an engagement contour 32 on a second carriage 33. Through the engagement of the synchronization wheel 31 in the engagement element 30 of carriage 27 and in the engagement contour 32 on the second carriage 33, it is possible, for example, to synchronize the movement of the central rail 11 and of the drawer rail 12 in the opening and closing direction P1, P2.

The second carriage 33 has a row of rolling elements 34, wherein the rolling elements 34 are arranged between the upper running web 20 of the central rail 11 and a running web 35 of the drawer rail 12. The rolling elements 34 can be moved along an upper running surface 36 of the upper running web 20 of the central rail 12 and a running surface 37 of the running web 35 of the drawer rail 12. The drawer 3 preferably rests by means of the drawer bottom 13 on the upper surface of the running web 35 of the drawer rail 12. The second carriage 33 preferably furthermore comprises lateral supporting elements 38, wherein the lateral supporting elements 38 are arranged, for example, between the lateral running webs 39 of the central rail 11 and the lateral running webs 40 of the drawer rail 12. The carriage 33 is also moved, for example, in a supporting manner along the running surfaces 36, 37 and lateral running surfaces 39, 40 of the central rail 11 and the drawer rail 12, respectively.

Figure 4:
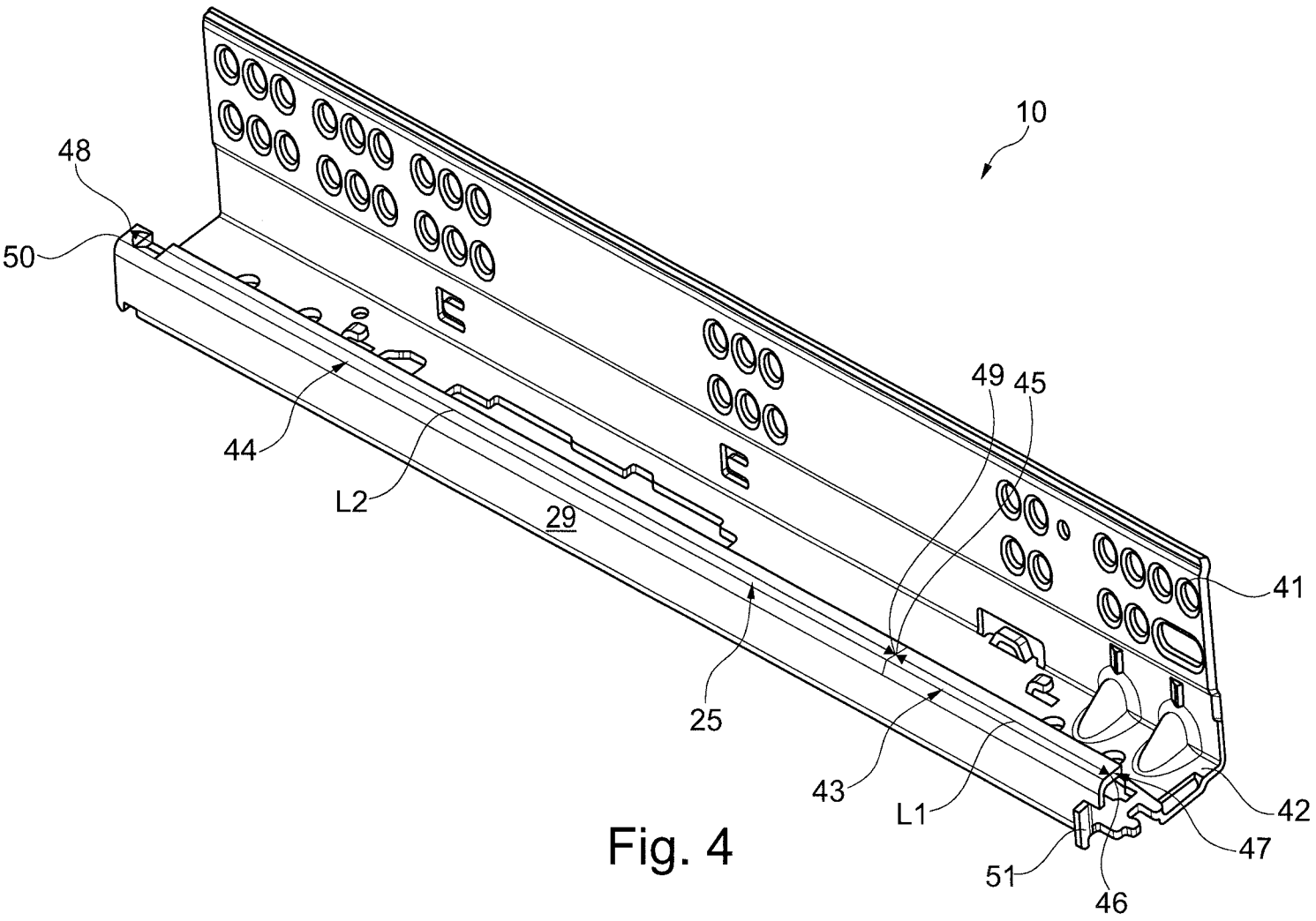
FIG. 4 shows a perspective view obliquely from above of a carcass rail according to FIG. 2.
Figure 5:
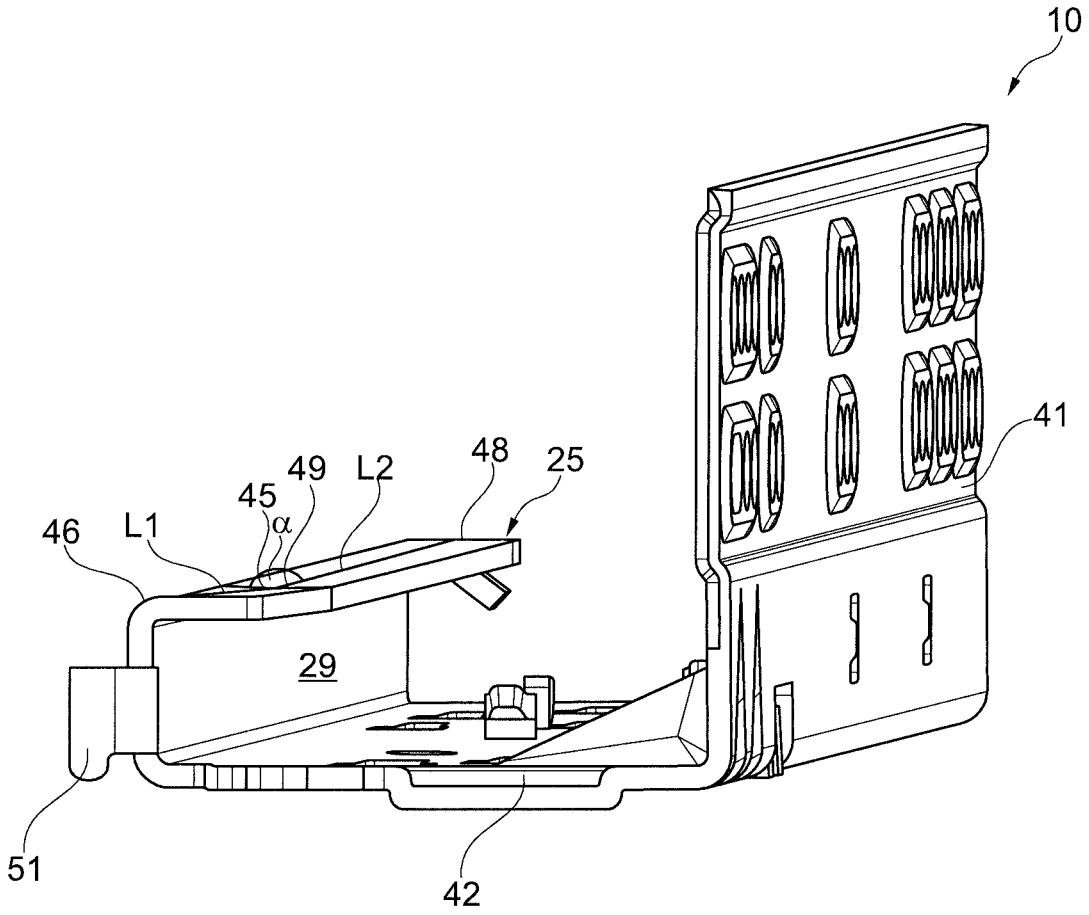
FIG. 5 shows a perspective view obliquely from the front of a carcass rail according to FIG. 3.

FIGS. 4 and 5 illustrate the carcass rail 10 in different views. The carcass rail 10 is formed in one piece as a bent sheet-metal part, for example. The carcass rail 10 comprises a mounting strip 41, a bottom plate 42, the lateral running web 29 and the running web 18. By means of the mounting strip 41, the carcass rail 10 can be secured on the side wall 8, 9 of the furniture carcass 2 by fastening mechanisms, such as, for example, screws. The bottom plate 42, the lateral running web 29 and the running web 18 preferably form a U shape, wherein the bottom plate 42 connects the mounting strip 41 and the lateral running surface 29 to one another. The U shape is preferably open in the direction of the mounting strip 41. The lateral running surface 29 preferably connects the running surface 18 and the bottom plate 42.

As illustrated in FIGS. 4 and 5, the running surface 25 of the carcass rail 10 advantageously has two running sections 43, 44. The running sections 43, 44 preferably each form a plane, wherein the planes of the running sections 43, 44 have a longitudinal extent L1, L2 and a transverse extent. The longitudinal extent L1 of a first running section 43 extends from a starting point 45 to an end point 46, wherein the end point 46 preferably ends at a front end-side edge 47 of the running surface 25 of the carcass rail 10. The longitudinal extent L2 of a second running section 44 extends from a starting point 48 to an end point 49, wherein the starting point 48 begins at a rear end-side edge 50 of the running surface 25 of the carcass rail 10. In the mounted state of the carcass rail 10, the front end-side edge 47 of the running surface 25 of the carcass rail 10 is arranged on the side wall 8, 9 of the furniture carcass 2 in the vicinity of the opening 52 of the furniture carcass 2. With a closed drawer 3, the front end-side edge 47 of the running surface 25 of the carcass rail 10 is situated in the downstream region of the drawer front 16.

Since the first running section 43 merges smoothly into the second running section 44, the end point 49 of the longitudinal extent L2 of the second running section 44 corresponds, for example, to the starting point 45 of the longitudinal extent L1 of the first running section 43.

The longitudinal extent L1 of the plane of the first running section 43 is preferably oriented obliquely relative to the longitudinal extent L2 of the plane of the second running section 44. The transverse extents of the planes of the first and second running sections 43, 44 are perpendicular to the longitudinal extent of the planes of the first and second running sections 43, 44, wherein the transverse extent of the first running section 43 is parallel to the transverse extent of the second running section 44. The transverse extents of the two running sections 43, 44 are preferably not tilted relative to one another. The angle $\alpha$ which is enclosed between the longitudinal extent of the first running section and the longitudinal extent of the second running section is preferably less than 180° and greater than 170°.

In the mounted state of the carcass rail 10 on the side wall 8, 9 of the furniture carcass 2, the longitudinal extent L2 of the plane of the second running section 44 is preferably oriented horizontally, wherein the longitudinal extent L1 of the plane of the first running section 43 is oriented transversely with respect to a horizontal or vertical. The end point 46 of the longitudinal extent L1 of the first running section 43 and the end point 49 of the longitudinal extent L2 of the second running section 44 are advantageously spaced apart vertically from one another or have a height difference (see FIG. 5). This height difference advantageously contributes to compensating for the lowering of the drawer 3 in the open state. The total longitudinal extent of the running surface 25 comprises the longitudinal extent L1 of the first running section 43 and the longitudinal extent L2 of the second running section 44, wherein the longitudinal extent L1 of the first running section 43 is 10% to 40% of the total longitudinal extent of the running surface 25 of the carcass rail 10.

Figure 6:
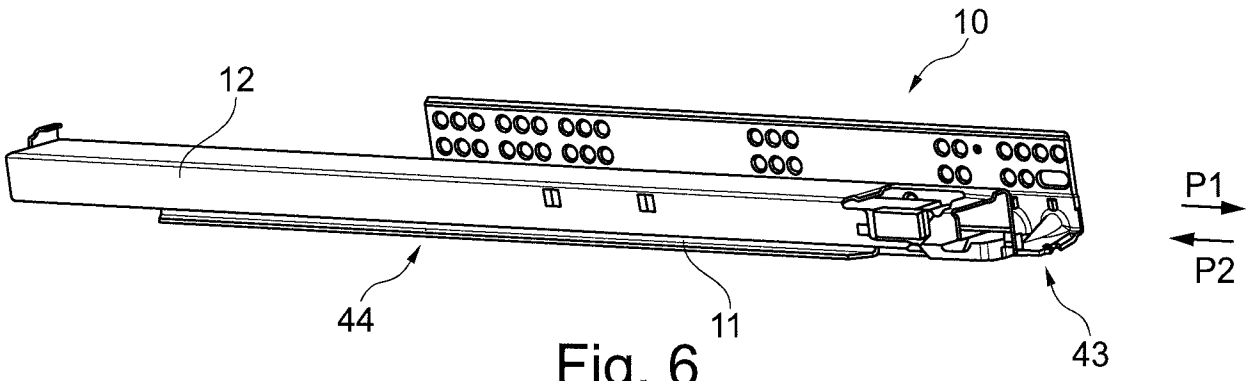
FIG. 6 shows a perspective side view obliquely from above of a device according to FIG. 2 in the closed state.
Figure 7:
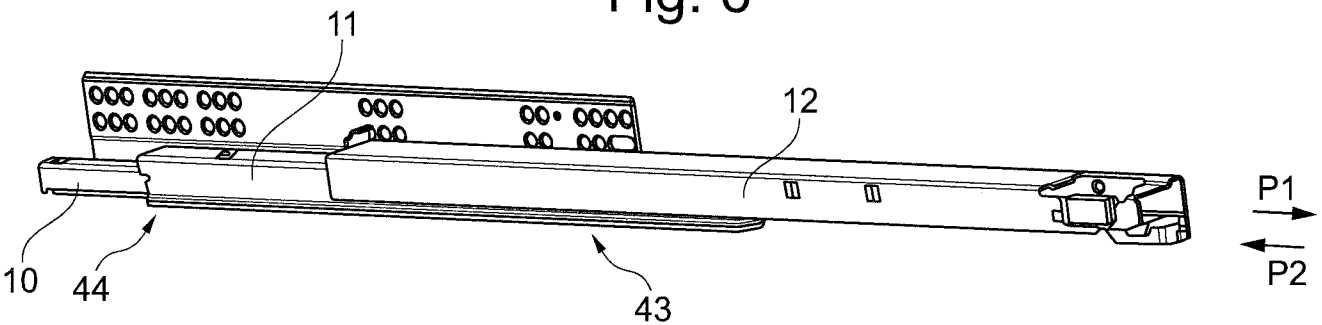
FIG. 7 shows a perspective side view obliquely from above of a device according to FIG. 6 in the half-extended state.
Figure 8:
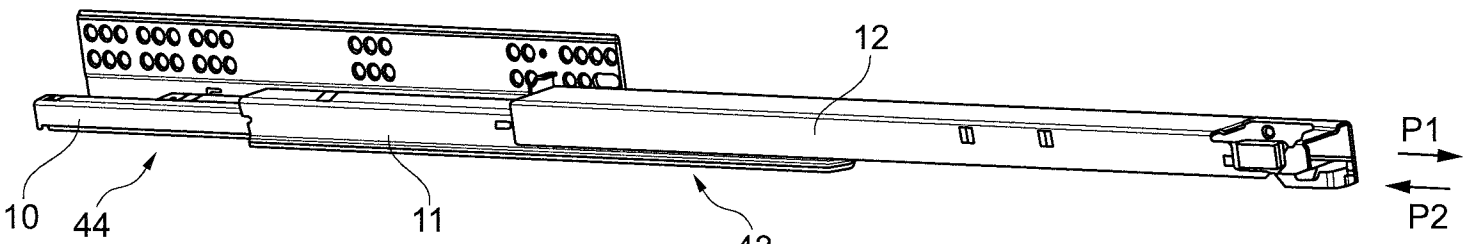
FIG. 8 shows a perspective side view obliquely from above of a device according to FIGS. 6 and 7 in the fully opened state.

In FIGS. 6 to 8, the device 4 is illustrated in the different states during the movement of the drawer 3 in the opening direction. FIG. 6 shows the closed state, FIG. 7 shows the half-extended state, and FIG. 8 shows the fully extended or fully open state. In FIGS. 6 to 8, only the carcass rail 10 has two running sections 43, 44.

In the closed state of the drawer 3, the 3 rails 10, 11, 12 lie one above the other (see FIG. 6), wherein a rear end of the running surfaces 22, 26, 36, 37 of the central rail 11 and of the drawer rail 12 preferably project beyond the second running section 44 of the running surface 25 of the carcass rail 10. In the mounted state of the carcass rail 10 on the side wall 8, 9 of the furniture carcass 2, the rear ends of the running surfaces 22, 26, 36, 37 of the central rail 11 and of the drawer rail 12 lie in the vicinity of the rear wall 7 of the furniture carcass 2, for example. In the mounted state, the first running section 43 of the running surface 25 of the carcass rail 10 is preferably arranged in the vicinity of the opening 52 of the furniture carcass 2, wherein the front ends of the running surfaces 22, 26, 36, 37 of the drawer rail 12 and of the central rail 11 are preferably also arranged in the vicinity of the opening 52 of the furniture carcass 2 in the closed state of the drawer 3. Since, in the mounted state, the upper surface of the drawer rail 12 is connected, for example, to the drawer bottom 13, the front end of the running web 35 of the drawer rail 12 and thus also of the running surface 37 of the drawer rail 12 preferably rests against the drawer front 16, and the rear end of the running web 35 of the drawer rail 12 rests against the drawer rear wall 17 during the opening and closing movement of the drawer 3.

In the closed state of the drawer 3, the carriages 27, 33 are arranged, for example, centrally on the rails 10, 11, 12 or running surfaces 22, 23, 25, 26, 36, 37 of the rails 10, 11, 12. Thus, the carriage 27, in which the rolling elements 21, 24 are arranged between the running web 18 of the carcass rail 10 and the running webs 19, 20 of the central rail 11, is preferably situated on the second running section 44 of the running surface 25 of the carcass rail 10. In this way, the longitudinal extents of the running webs 19, 20, 35 or of the running surfaces 22, 26, 36, 37 of the central rail 11 and of the drawer rail 12 are preferably oriented parallel to the longitudinal extent L2 of the second running section 44 of the carcass rail 10. In other words, in the mounted state of the carcass rail 10 on the side wall 8, 9 of the furniture carcass 2, the longitudinal extents of the running surfaces 22, 26, 36, 37 of the central rail 11 and drawer rail 12, as well as the longitudinal extent L2 of the second running section 44 of the carcass rail 10, are preferably oriented horizontally.

If the drawer 3 is now moved from a closed position in the opening direction P1, the central rail 11 is moved relative to the carcass rail 10, and the drawer rail 12 is moved relative to the central rail 11 and carcass rail 10, for example (see FIG. 7). In this process, the carriages 27, 33 are moved along the running surfaces 22, 23, 25, 26, 36, 37 of the rails 10, 11, 12, wherein the carriage 27, in which the rolling elements 21, 24 are arranged between the running web 18 of the carcass rail 10 and the running webs 19, 20 of the central rail 11, hardly moves in the opening direction P1. This means that carriage 27 is preferably still situated on the second running section 44 of the carcass rail 10 even in the semi-extended state (see FIG. 7) and thus the running surfaces 22, 26, 36, 37 of the drawer rail 12 and the central rail 11 continue to be oriented horizontally. In the half-extended state, carriage 33, in which the rolling elements 34 are arranged between the running web 20 of the central rail 11 and the running web 35 of the drawer rail 12, is situated approximately halfway along the running web 20 of the central rail 11 and approximately in the front half of the running web 18 of the carcass rail 10. In this case, the front half of the running web 18 of the carcass rail 10 is preferably the half of the running web 18 which is oriented in the direction of the opening 52 of the furniture carcass 2.

During the further opening movement of the drawer 3 or of the central rail 11 and of the drawer rail 12 in the opening direction P1, carriage 27 reaches the rear end of the central rail 11 during the relative movement between the central rail 11 and the carcass rail 10, wherein there is a boundary feature (not illustrated) for the carriage 27 at the rear end of a lateral running web 39 of the central rail 11, thus enabling the carriage 27 to be moved in the opening direction P1 with the central rail 11 at the rear end of the central rail 11 by the boundary feature. In this case, the carriage 27 preferably reaches a stop 51 (see FIG. 4) at the front end of the carcass rail 10, and therefore the carriage 27 cannot be moved any further in the opening direction P1.

Carriage 33 is also preferably moved to the rear end of the drawer rail 12 during the relative movement between the central rail 11 and the drawer rail 12. In this case, e.g. at the rear end of a lateral running web 40 of the drawer rail 12, there is, for example, a boundary feature (not illustrated) for the carriage 33, thus enabling the carriage 33 to be moved in the opening direction P1 with the drawer rail 11 at the rear end of the drawer rail 11 by the boundary feature.

When the drawer 3 is fully open (see FIG. 8), the carriage 27 or the rolling elements 24 is preferably situated between the stop 51 of the carcass rail 10 and the boundary feature of the central rail 11, with the result that the rolling elements 24 are now on the first running section 43 of the carcass rail 10. As a result, the carriage 27 and thus also the longitudinal extent of the running surface of the central rail 11 are preferably oriented obliquely upward or obliquely with respect to a horizontal or vertical. That is to say that the longitudinal extent of the running surface 22, 26, 36 of the central rail 11 is oriented obliquely relative to the longitudinal extent L2 of the second running section 44 of the carcass rail 10. As a result of the oblique position of the running surfaces 22, 26, 36 of the central rail 11, the running surface 37 of the drawer rail 12 is also oriented obliquely upward, wherein the longitudinal extent of the running surface 22, 26, 36 of the central rail 11 and the longitudinal extent of the running surface 37 of the drawer rail 12 are approximately parallel.

LIST OF REFERENCE SIGNS

1 furniture
2 furniture carcass
3 drawer
4 device
5 base
6 upper panel
7 rear wall
8 side wall
9 side wall
10 carcass rail
11 central rail
12 drawer rail
13 drawer bottom
14 drawer side wall
15 drawer side wall
16 drawer front
17 drawer rear wall
18 running web
19 running web
20 running web
21 rolling element
22 running surface
23 running surface
24 rolling element
25 running surfaces
26 running surfaces
27 carriage
28 rolling element
29 lateral running web
30 engagement element
31 synchronization wheel
32 engagement contour
33 carriage
34 rolling element
35 running web
36 running surface
37 running surface
38 supporting body
39 lateral running web
40 lateral running web
41 mounting strip

42 bottom panel
43 running section
44 running section
45 starting point
46 end point
47 edge
48 starting point
49 end point
50 edge
51 stop
52 opening

The invention claimed is:

1. A device for guiding a movable furniture part, in particular a drawer, which can be received movably on a furniture carcass by means of the device, wherein the device comprises:

a carcass rail; and a drawer rail, wherein the carcass rail can be arranged on the furniture carcass, wherein the movably mounted drawer rail can be moved in an opening and closing direction relative to the carcass rail, wherein the carcass rail and the drawer rail each have at least one flat running surface, wherein the running surface of the drawer rail is continuously uniformly flat, wherein, during the relative movement between the drawer rail and the carcass rail, load-transmitting rolling elements can be moved along the running surface of the carcass rail and the drawer rail, wherein the running surface extends in a longitudinal extent and a transverse extent, wherein the longitudinal extent is perpendicular with respect to the transverse extent, wherein the longitudinal extent of the running surface is oriented in the opening and closing direction of the drawer rail, wherein the longitudinal extent of the running surface of the carcass rail is divided into two running sections, wherein the running sections of the running surface merge into one another without an offset, wherein, relative to a plane of a second running section, a plane of a first running section is oriented obliquely as regards the longitudinal extent and is not tilted as regards the transverse extent, wherein the total longitudinal extent of the running surface has exactly two running sections, and wherein, in the mounted state of the device, the longitudinal extent of the second running section is oriented horizontally.

2. A device for guiding a movable furniture part, in particular a drawer, which can be received movably on a furniture carcass by means of the device, wherein the device comprises:

a carcass rail;

a drawer rail; and a central rail, wherein the central rail is arranged between the carcass rail and the drawer rail, wherein the carcass rail can be arranged on the furniture carcass, wherein the movably mounted drawer rail and the central rail can be moved in the opening and closing direction relative to the carcass rail, wherein the carcass rail, the central rail and the drawer rail each have at least one flat running surface, wherein the running surface of the drawer rail is continuously uniformly flat, wherein, during the movement of the drawer rail and/or central rail relative to the carcass rail, load-transmitting rolling elements can be moved along the running surfaces of the rails, wherein the running surface extends in a longitudinal extent and a transverse extent, wherein the longitudinal extent is perpendicular with respect to the transverse extent, wherein the longitudinal extent of the running surface of the rails is oriented in the opening and closing direction of the drawer rail, wherein the longitudinal extent of the running surface of the carcass rail and/or central rail is divided into two running sections, wherein the running sections of the running surfaces merge into one another without an offset, wherein, relative to a plane of a second running section, a plane of a first running section is oriented obliquely as regards the longitudinal extent and is not tilted as regards the transverse extent, and wherein the total longitudinal extent of the running surface has exactly two running sections.

3. The device for guiding a movable furniture part as claimed in claim 1, wherein a longitudinal extent of the first and second running sections in each case has a starting point and an end point, and wherein the starting point of the second running section and the end point of the first running section are formed on an end-side edge of the running surface.

4. The device for guiding a movable furniture part as claimed in claim 3, wherein the end point of the longitudinal extent of the second running section corresponds to the starting point of the longitudinal extent of the first running section.

5. The device for guiding a movable furniture part as claimed in claim 1, wherein, in the mounted state of the device, the first running section is formed on a front end region of the rail in the opening direction of the drawer rail.

6. The device for guiding a movable furniture part as claimed in claim 1, wherein the longitudinal extent of the second running section of the rail extends over 60-90% of the total longitudinal extent of the running surface of the rail.

7. The device for guiding a movable furniture part as claimed in claim 1, wherein the longitudinal extent of the first running section of the rail extends over 10-40% of the total longitudinal extent of the running surface of the rail.

8. The device for guiding a movable furniture part as claimed in claim 1, wherein, in the mounted state of the device, the end point of the longitudinal extent of the first running section and the end point of the longitudinal extent of the second running section are spaced apart vertically from one another.

9. A piece of furniture having a movable furniture part which can be moved in the opening and closing direction relative to the furniture carcass by means of a device as claimed in claim 1.

* * * * *